US005186340A

United States Patent [19]

Vardaro

[11] Patent Number: 5,186,340

[45] Date of Patent: Feb. 16, 1993

[54] INTERLOCKING MODULAR TRAY STRUCTURE

[76] Inventor: Antonio Vardaro, c/o 11820 Adolphe Caron, Montreal, Quebec, Canada, H1E 6J8

[21] Appl. No.: 745,339

[22] Filed: Aug. 15, 1991

[30] Foreign Application Priority Data

Feb. 5, 1991 [CA] Canada ..... 2041749

[51] Int. Cl.[5] ..... A47F 3/14

[52] U.S. Cl. ..... 211/133; 211/188; 211/71

[58] Field of Search ..... 211/126, 59.2, 45, 130, 211/132, 133, 71, 186, 188, 194

[56] References Cited

U.S. PATENT DOCUMENTS

| | | | |
|---|---|---|---|
| 1,576,420 | 3/1926 | Folts | 211/126 X |
| 1,890,143 | 12/1932 | Bales | 211/126 |
| 2,915,162 | 12/1959 | Umstead | 211/59.2 X |
| 3,126,101 | 3/1964 | Katterjohn | 211/133 X |
| 3,387,713 | 6/1968 | Brooke | 211/188 |
| 3,478,892 | 11/1969 | Lockwood | 211/126 |
| 3,874,510 | 4/1975 | Perry et al. | 211/194 X |
| 3,926,314 | 12/1975 | Dogliotti | 211/71 |
| 4,204,480 | 5/1980 | Hanna | 211/187 X |
| 4,293,071 | 10/1981 | Bridges | 211/133 X |
| 4,550,837 | 11/1985 | Simmons | 211/126 |
| 4,930,640 | 6/1990 | Edwards | 211/45 X |

FOREIGN PATENT DOCUMENTS

| | | | |
|---|---|---|---|
| 1332225 | 6/1963 | France | 211/126 |
| 1341493 | 9/1963 | France | 211/126 |

*Primary Examiner*—Carl D. Friedman
*Assistant Examiner*—Korie H. Chan
*Attorney, Agent, or Firm*—McFadden, Fincham, Marcus & Anissimoff

[57] ABSTRACT

There is disclosed a modular interlocking tray structure including a plurality of individual trays. Each tray is adapted for releasable interengagement with a further vertically preceding and succeeding tray when in an opposed and divergent relationship. The structure provides a vertically assembled and space conserving structure which is devoid of any additional supports.

10 Claims, 4 Drawing Sheets

INTERLOCKING MODULAR TRAY STRUCTURE

FIELD OF THE INVENTION

This invention relates to an interlocking tray structure and more particularly, it relates to a modular tray structure for the display and storage of various articles.

BACKGROUND OF THE INVENTION

Devices for display and storage of articles e.g. food products, stationery, etc., generally provide a plurality of trays which are connected and supported by a vertical support. Such supports are often mounted to a wall etc. or, may be self-supporting. In this type of arrangement, the articles to be displayed must always be displayed in the same area, without any freedom with respect to repositioning for increased exposure to consumers. In addition, the known tray structures often require a significant portion of floor area while not providing a particularly aesthetic presentation for a product to be displayed.

Numerous shelving and tray systems are disclosed in the art, an exemplification of which is Canadian Patent No. 1,190,523. This reference discloses a shelving system in which there is included two pairs of vertical standards, each pair of which support shelves extending therebetween and laterally therefrom. The shelves include fastening means for fastening the shelves to the standards.

Further, a modular unit for display and storage is disclosed in Canadian Patent No. 1,277,141. The modular unit provides an upright support formation having an inclined front wall panel which includes spaced apart parallel rows of folded strips of sheet metal. The shelf modules each include an anchoring flange which is received within the parallel rows of sheet metal strips. The individual shelf modules, in such an arrangement, overlie one another such that the top portion of an individual shelf is in contact with a preceding shelf module.

In U.S. Pat. No. 3,097,746, there is disclosed tray shelving which incorporates a plurality of trough shaped tray members which provide ears or lugs to engage with slots on vertical standards. The arrangement disposes the tray members in a downwardly inclined vertical attitude and allows for vertical elevation adjustment. A similar arrangement is documented in U.S. Pat. No. 3,122,238.

Further U.S. references include U.S. Pat. Nos. 3,347,394 and 3,365,070.

Collectively, none of these references is well suited for maximum product display in a minimum of surface area, nor are the arrangements disclosed adapted for expedient repositioning. There is, therefore, a need for a structure which does not have the inherent limitations of those tray structures known in the art.

SUMMARY OF THE INVENTION

According to one object of the present invention, there is provided a tray structure having a plurality of first and second trays, each tray including a base wall, a pair of opposed walls and at least one side wall between the opposed walls, the improvement wherein:

each of the opposed walls of each of the first and second trays includes a tapered segment having at least one projection operatively associated therewith and at least one aperture adjacent the side wall positioned to releasably receive the at least one projection of the first tray when the second tray is in a superposed and back-to-front relationship with the first tray.

The individual trays include a base wall and preferably three side walls. The trays in one form, may provide solid walls or may be fabricated from stiff wire known in the art.

Suitable materials for use in fabricating the trays include, for example, suitable metals e.g. steel, aluminium, or rigid plastics e.g. PVC, ABS, etc.

The choice of material may be selected depending upon the type of articles to be displayed.

Solid walled tray modules may be stamped into the required shape and, in the case of wire trays, suitable wire forming apparatus may be used to achieve a desired shape. In addition, the solid trays may be punched to decrease their weight, without sacrificing any strength.

Further, the trays, depending upon the material of which they are composed, may be electroplated for decorative purposes with various plating materials known in the art, e.g. chromium, suitable resin materials, etc.

The opposed walls of each tray include a downwardly tapering portion and, spaced therefrom, a side wall extending between the opposed walls perpendicular to the bottom wall. The tapering portion of each opposed wall abuts the undersurface of the bottom wall of a superposed structure. As such, the angle of the tapering portion indicates the angle at which the trays are inclined relative to each other.

The first and second cooperating engaging means are both associated with each tray in a spaced apart relationship. In this arrangement, the first cooperating means of one tray may be engaged with the second cooperating means of a second tray when they are in an opposed relationship.

In one form, the first cooperating engaging means comprises at least one lug member, e.g. a lazy tong connected to each of the tapered portions of the opposed walls. Spaced therefrom and on the bottom wall of each tray there are included slots adapted to receive the tongs for releasable engagement.

In another form, the first and second cooperating means may comprise known tube and sleeve arrangements suitably positioned to facilitate opposed connection between the trays.

Other known cooperating means which permit opposed connection will be readily apparent to those skilled in the art.

The engaged tray structures may be readily disassembled and stored in an opposed overlying relationship to provide a rectangular structure.

The present invention provides versatility in terms of merchandise storage and display. In one form, the tray structure may be placed against a wall thus providing storage space for articles on one side with display area spaced from the wall.

Further, the structure may be positioned within an area allowing double sided displays.

A further object of the present invention is to provide a display structure comprising:

a plurality of first and second display trays, each of the trays including:

a base wall;

a pair of opposed walls; and at least one side wall extending between the opposed walls, opposed side wall of each of the first and second display trays including a tapered segment having at least one projection operatively associated therewith and at least one aperture adjacent the side wall positioned to releasably receive the projection of the first trays when the second trays is in a superposed relationship with the first container.

Many units may be juxtaposed and joined together by suitable means, e.g. bolting, riveting, clamping, etc.

For existing storage means, e.g. filing cabinets, etc., one or more units of the present invention may be combined therewith for more storage space.

In applications where floor space is limited, the modular tray structure may be suspended from a ceiling, or anchored to a wall by suitable means.

The modular tray structure of the present invention may optionally include base means for mounting the interengaged tray structure thereon. The base means may include castors, wheels, rollers etc., which allow the structure to be readily moved from one location to another.

The base means may additionally take the form of a tray or may include track means for cooperation with floor rails in known track arrangements.

A further object of the present invention is to provide a self-supporting storage assembly comprising:

a plurality of first and second storage trays, each of the trays including a bottom wall, a pair of spaced apart side walls of each of the first and second trays including a tapered segment having at least one projection operatively associated therewith and at least one aperture adjacent the back wall;

a plurality of connecting members for connecting the first and second storage trays, the connecting members including at least one projection adapted for releasable engagement with the projection of the first tray, the connecting members further including at least one aperture adapted for releasable engagement with at least one projection of the second tray;

whereby the storage trays when connected by the connecting members are in a parallel and vertically spaced apart relationship.

In an alternate embodiment, the tray structure may include lateral extensions for additional storage and/or display space.

In a further embodiment, the trays may include horizontal and vertical dividers useful for displaying individually packaged articles.

According to a further aspect of the present invention, there is provided a self-supporting display structure comprising:

a plurality of first and second display trays, each of the trays including:

a base wall;

a pair of opposed walls;

at least one projection operatively associated with and angularly inclined relative to the base wall; and a second wall spaced from at least one projection having a groove therein positioned to releasably receive at least one projection of a first tray when a second tray is in a superposed relationship therewith.

Having thus generally described the invention, reference will now be made to the accompanying drawings illustrating preferred embodiments.

DETAILED DESCRIPTION OF THE PREFERRED EMBODIMENTS

Figure 1:
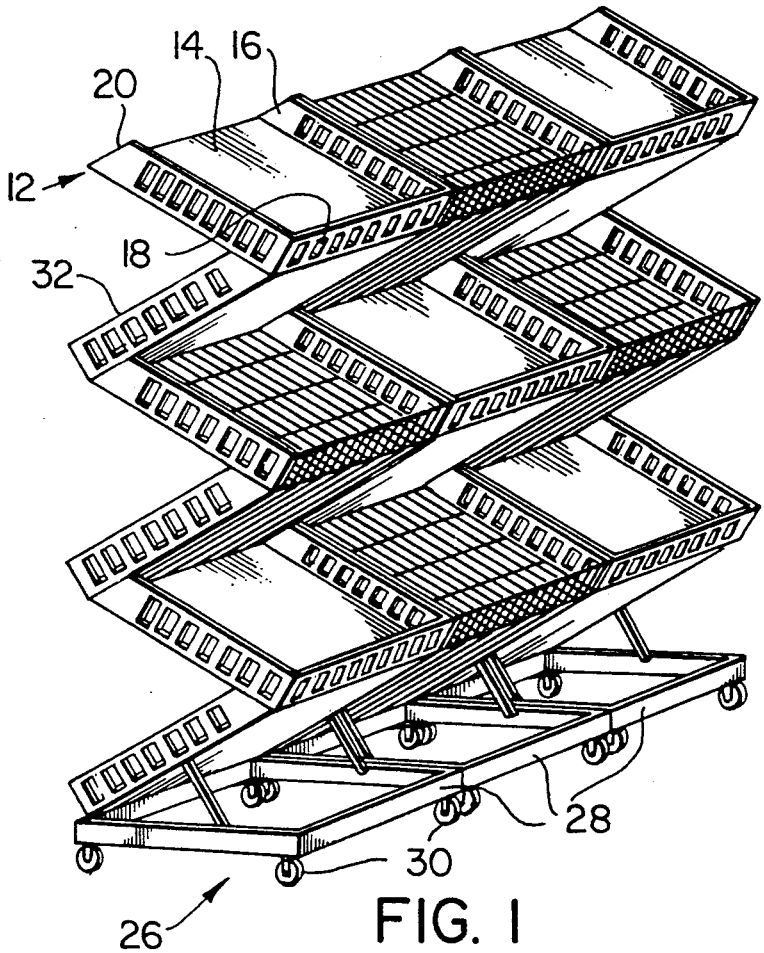
FIG. 1 is a perspective view of the present invention.
Figure 2:
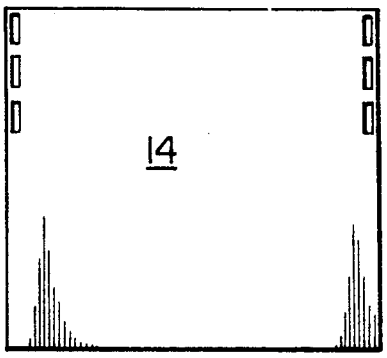
FIG. 2 is a top plan view of an individual tray of the present invention.

Referring to FIG. 1, shown is a perspective view of the present invention in an assembled form generally indicated by numeral 10. The tray structure 10 comprises a plurality of individual trays 12 engaged in an opposed and angularly inclined attitude with respect to each other. Each tray 12 preferably includes a base wall 14 and a pair of spaced apart opposed walls 16. A side wall 18 extends between and connects the pair of opposed walls 16.

The individual trays 12 may be fabricated from suitable materials, e.g. steel, aluminum, PVC, ABS, etc. and the choice of material will depend on the intended use of the structure. In addition, the trays may include solid walls or be formed of stiff wire or a combination of both. Known techniques, e.g. wire forming, stamping procedures, machining, etc. may be employed to achieve the desired shape of the trays 12.

It is preferred that each of the opposed walls 12, at the ends opposed from side wall 18, each include a downwardly tapering segment 20 which terminates at the base wall 14. The tapering segments 20 are from about 15° to about 55° and desirably from about 30° to about 45° with respect to the vertical.

The trays 12 each include first cooperating engaging means 22 and, spaced therefrom, second cooperating engaging means 24. It is preferred that the first and second cooperating engaging means 22 and 24 facilitate engagement of a pair of trays 12 when they are in an opposed and angularly inclined attitude with respect to one another.

Figure 3:
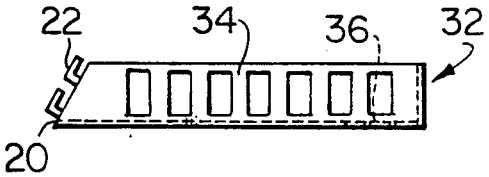
FIG. 3 is a side view of FIG. 2.

In one form, the interengagement between the trays 12 is achieved by providing at least one lug or lazy tong member known to those skilled in the art for the first cooperating engaging means 22 shown in FIG. 3. The lazy tongs 22 project upwardly from and parallel to the tapered, segment 20 of each opposed wall 16. The lazy tongs 22 may be integral with the opposed walls 16 or comprise a separate portion suitably affixed to the inside of each opposed wall 16 by e.g. welding.

Referring to the second cooperating engaging means 24, it is preferred that such means 24 be located within base wall 14 proximate side wall 18 and spaced inwardly from each opposed wall 16. The second cooperating means 24 comprises slots adapted to releasably engage the lazy tongs 22 of a tray 12. A plurality of slots 24 are provided for adjustment purposes.

The trays 12 may be engaged by positioning the tongs 22 within the slots 24 and sliding the lower tray having the tongs 22 into engagement with the slots 24 to provide locked engagement therebetween. In this arrangement, the tapered portions 20 of each opposed wall abut against the undersurface of base wall 14 of a preceding tray 12 thus providing support.

Having the individual trays 12 disposed at an angle to each other is particularly useful for the display of small packaged articles. As an article is removed from the tray 12, other articles, due to the angular disposition of the trays 12, readily slide down against side wall 18 of each tray. This ensures that the display articles are always neatly presented.

Referring to FIG. 1, the tray structure may optionally include base means 26. As illustrated in the Figure, the base means 26, may include a support frame 28 and wheels, castors, etc. 30 to provide mobility.

The base means 26 may take many forms including a further tray 12, guide means for use in tracked flooring or, in a further alternative, the entire structure may be suspended or anchored to a wall.

Figure 4:
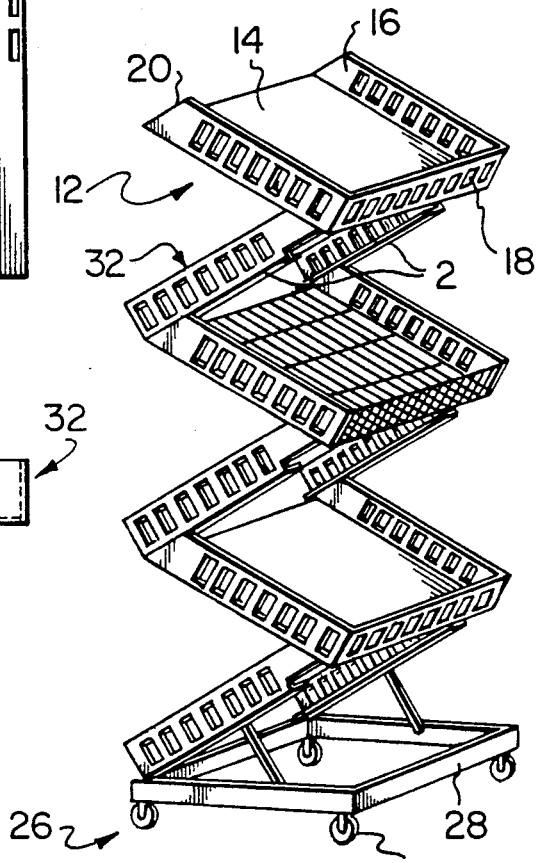
FIG. 4 is a perspective view of an alternate embodiment of the invention.

Referring now to FIG. 4, shown is a further embodiment of the present invention. Similar numerals refer to similar components.

In the embodiment illustrated in FIG. 4, the structure, instead of incorporating trays 12 on both sides in an inclined attitude, provides storage and/or display space on one side only by disposing the trays 12 in an inclined and vertically spaced apart relationship.

Figure 5:
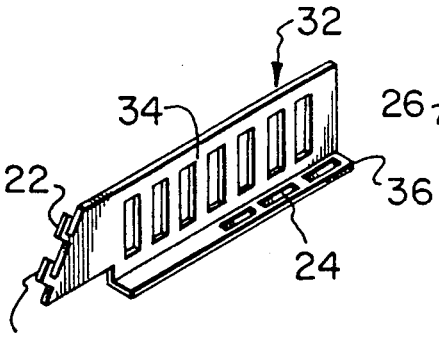
FIG. 5 is a perspective view of the connecting means for use in FIG. 4.

In this arrangement, the trays 12 may be connected by connecting means 32 shown in FIG. 5. The connecting means 32 includes tongs 22 positioned on a wall 34 in a similar manner to those disposed on the opposed walls of the trays 12. In addition, a partial wall 36 extends laterally from wall 34 and includes slots 24.

To engage a pair of trays 12, the tongs 22 of connecting means 32 may be engaged with the slots 24 of a first tray, while the slots of the connecting means 32 engage the tongs 22 of a second tray 12. One of the connecting means 32 will be connected on each side of the tray 12.

In such an arrangement, the tray structure is self-supporting and disposes the trays 12 in a downwardly inclined and vertically spaced apart relationship.

The tray structure may comprise a single structure 10, or several structures juxtaposed as illustrated in FIG. 1 by interconnection therebetween with suitable means, e.g. tongs and slots, bolting, welding, etc.

The structure may additionally include lateral extension trays extending from and suitably connected to opposed walls 16 of the tray structures.

Figure 6:
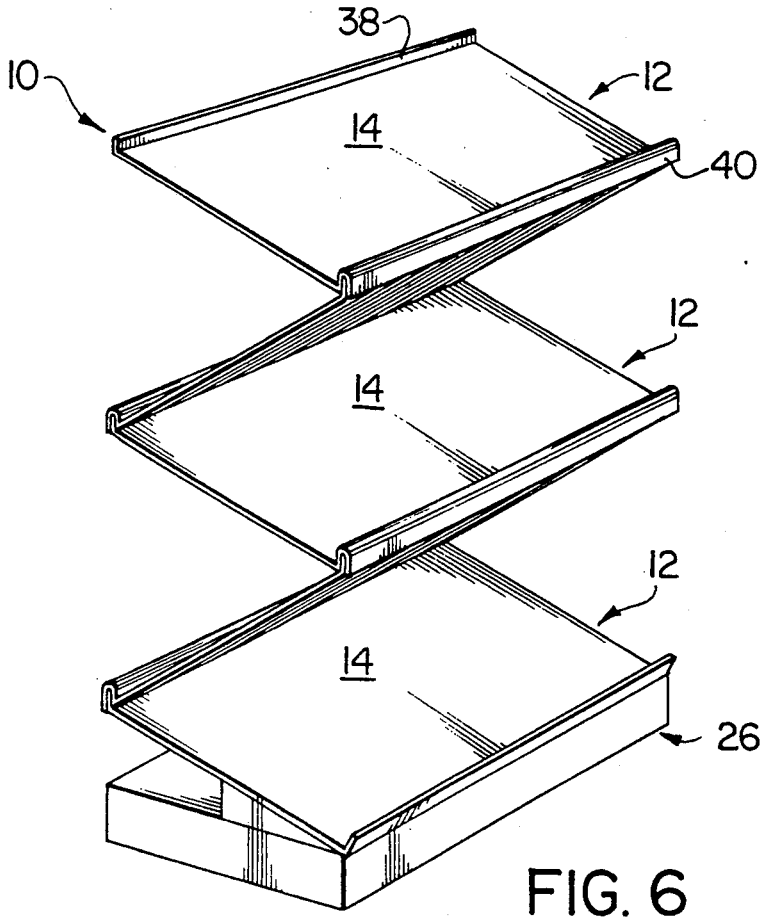
FIG. 6 is a perspective view of a further embodiment of the present invention.

FIG. 6 illustrates yet another embodiment of the present invention in which similar components from previous embodiments are indicated by similar numerals.

Figure 7:
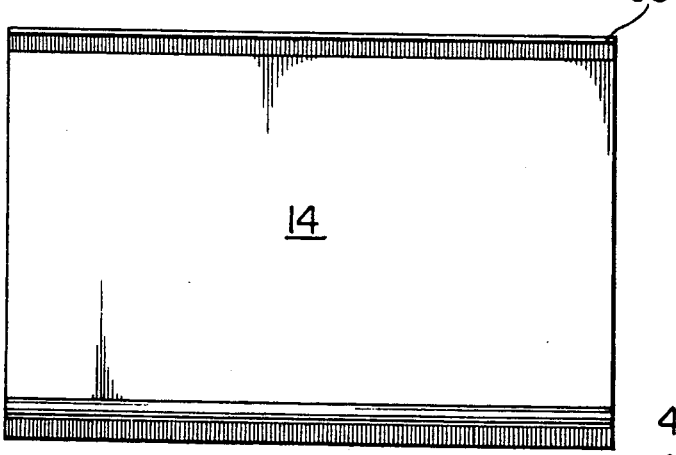
FIG. 7 is a top plan view of a tray in the structure illustrated in FIG. 6.
Figure 8:
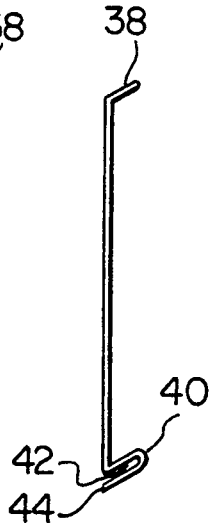
FIG. 8 is a side elevational view of FIG. 7.

In this embodiment, each of the trays 12 include a base extension or projection 38, illustrated in FIGS. 7 and 8, which is angularly inclined relative to and projecting upwardly from base 14. In the example, the projection transversely extends the width of each tray 12, however, this is not critical. The projection 38 may, for example, extend transversely medially of the tray 12 or may comprise separate projections.

The forward end of each tray 12 includes a wall 40 angularly inclined relative thereto, comprising an inverted U-shaped element, having a groove 42 extending therein.

The groove 42 of a first tray 12 is dimensioned to frictionally engage the base extension or projection 38 of a second underlying tray 12. The structure 10 may include similar base means 26 as discussed for previous embodiments.

Depending on the mass of the articles to be displayed on the trays 12, the projection 38 may be fastened within the grooves 42 by suitable means e.g. screwed, bolted, welded or adhesively bonded.

In the case where small packaged articles are to be displayed, surface relieved lanes (not shown) may be stamped within the base when the trays comprise metal or, such lanes may be associated with trays during an extrusion process.

Similar to the embodiment illustrated in FIG. 4, the tray structure illustrated in FIG. 6 may be structured to provide storage and/or display space on one side only. In this arrangement, the succeeding trays of each preceding tray may be configured to comprise connecting members substantially narrower than the tray width illustrated on each side of each preceding tray.

Figure 9:
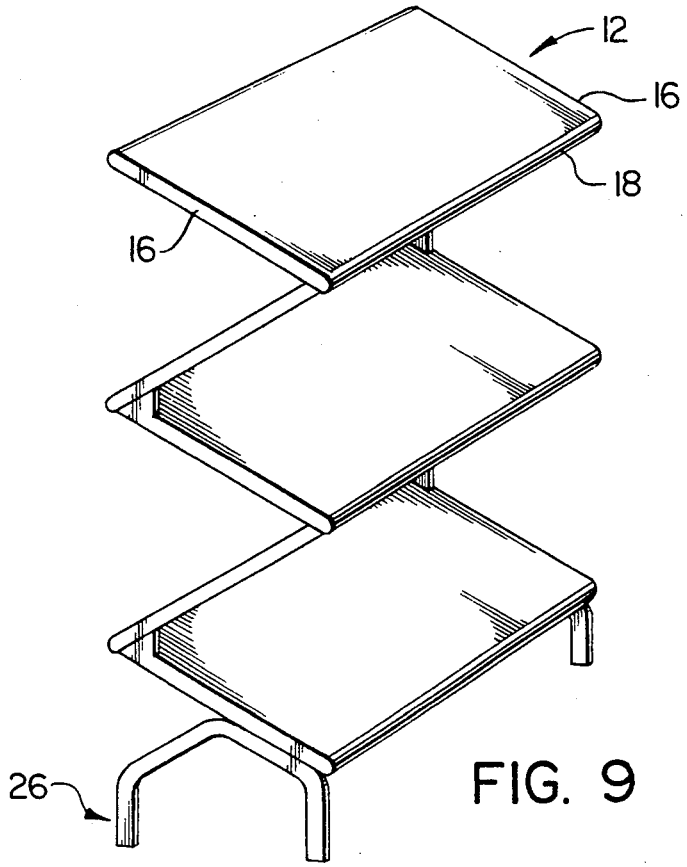
FIG. 9 is a perspective view of yet another embodiment according to the present invention.
Figure 10:
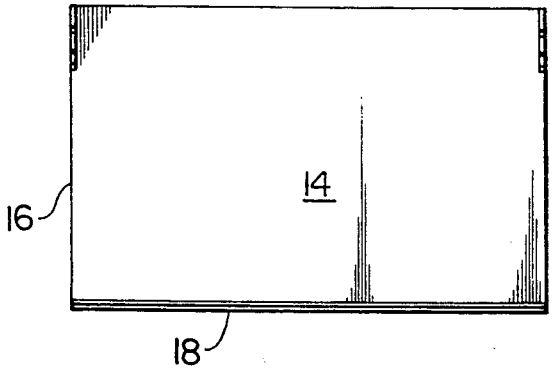
FIG. 10 is a top plan view of a platform of the structure of FIG. 9.
Figure 11:
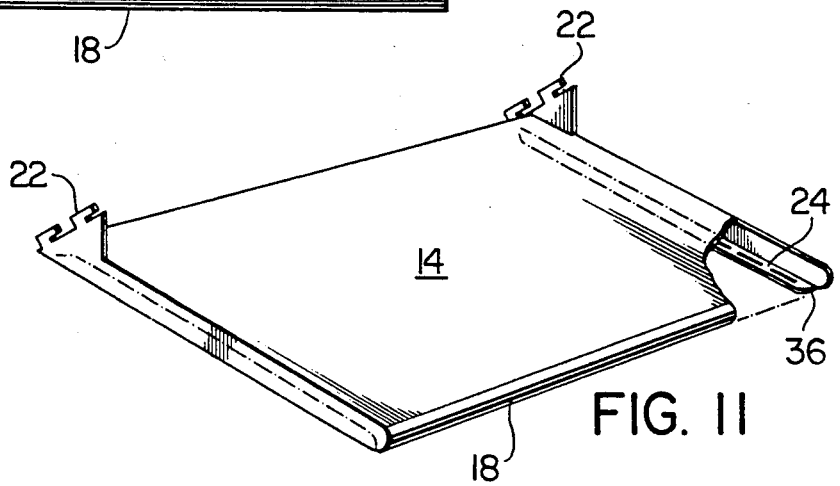
FIG. 11 is an enlarged perspective view of a platform in the structure illustrated in FIG. 9.

FIGS. 9 through 11 illustrate yet another embodiment of the display/storage structure according to the present invention, which share common reference numerals for similar components from previous embodiments.

In this embodiment, the tray structures each comprise a platform with bases 14 thereof including spaced apart sidewalls 12 and side wall 18 extending therebetween. The spaced apart walls 16 in this embodiment each include, similar to that illustrated in FIG. 5, partial wall 36 extending laterally from each wall 16 and including slots 24 therein for engagement with tong cooperating means 22 of succeeding tray as illustrated in FIG. 9. As discussed for the embodiment of FIG. 4, this embodiment may be readily modified to enable single sided display.

It will be appreciated that the embodiments illustrated in FIGS. 6 and 9 may include a plurality of such arrangements joined together laterally as discussed for the previous embodiments.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A display structure comprising:

a plurality of first and second cantilevered display trays, each of said trays including:

a base wall;

a pair of opposed walls each having opposed ends; and at least one side wall extending between said opposed walls, each said opposed wall of each of said first and second display trays including a tapered segment at one end and having at least one projection operatively associated therewith and at least one aperture at the other end adjacent said side wall; said apertures of said second tray positioned to releasably receive said projections of said first tray when said second tray is in a cantilevered relationship with said first tray.

2. The structure as defined in claim 1, wherein at least one projection comprises a lazy tong.

3. The structure as defined in claim 1, wherein said at least one aperture comprises a slot.

4. The structure as claimed in claim 1, each said opposed wall including an inwardly extending partial wall, said at least one aperture formed in said partial wall.

5. A tray structure comprising a plurality of cantilevered trays, extending one above another, each tray comprising a base, a pair of opposed walls and a side wall extending between said opposed walls at one end thereof;

a tapered segment extending from each opposed wall at the other end thereof and including at least one projection extending from said segment, in a plane normal to said base; and at least one aperture adjacent said one end of each opposed wall, the apertures adapted to receive said projections on said segments, to form the sole support for a second tray in a vertically superposed position above a first tray.

6. The tray structure as defined in claim 5, wherein said tray structure is self-supporting.

7. The tray structure as defined in claim 5, wherein said at least one projection is parallel to each said tapered segment.

8. The tray structure as defined in claim 5, wherein said projections are adapted for releasable locking engagement with said apertures.

9. The structure as claimed in claim 5, each said opposed wall including an inwardly extending partial wall, said at least one aperture formed in said partial wall.

10. A self-supporting storage assembly comprising:

a plurality of cantilevered storage trays, each of said trays including:

a base wall;

a pair of opposed walls;

at least one projections operatively associated with and angularly inclined relative to said base wall adjacent one end of each opposed wall;

a partial wall operatively associated with each opposed wall of said pair of opposed walls, each said partial wall including at least one slot positioned therein adjacent the other end of each opposed wall, the slots of a first tray positioned to releasably receive the projections of a second tray when the first tray is in a cantilevered superposed relationship therewith.

* * * * *